US009316106B2

(12) United States Patent
Barber

(10) Patent No.: US 9,316,106 B2
(45) Date of Patent: Apr. 19, 2016

(54) EXPANDING LOCK PIN FOR TURBINE SIDE ENTRY BLADE

(71) Applicant: Ralph R. Barber, Charlotte, NC (US)

(72) Inventor: Ralph R. Barber, Charlotte, NC (US)

(73) Assignee: SIEMENS ENERGY, INC., Orlando, FL (US)

( * ) Notice: Subject to any disclaimer, the term of this patent is extended or adjusted under 35 U.S.C. 154(b) by 427 days.

(21) Appl. No.: 13/945,946

(22) Filed: Jul. 19, 2013

(65) Prior Publication Data

US 2015/0023796 A1 Jan. 22, 2015

(51) Int. Cl.
*F04D 29/34* (2006.01)
*F01D 5/32* (2006.01)

(52) U.S. Cl.
CPC ..... *F01D 5/326* (2013.01); *F01D 5/323* (2013.01); *Y10T 29/49321* (2015.01)

(58) Field of Classification Search
CPC ..... F01D 5/323; F01D 5/326; F01D 5/3007; F01D 5/30; F01D 5/3053; F01D 5/32; F05D 2260/30
USPC ..... 416/221, 220 R
See application file for complete search history.

(56) References Cited

U.S. PATENT DOCUMENTS 3,603,626 A * 9/1971 Whiteside ..... F16B 5/02 403/408.1
3,720,481 A * 3/1973 Motta ..... F01D 5/147 416/207
4,676,723 A * 6/1987 Kiger ..... F01D 5/326 416/193 A
4,961,687 A * 10/1990 Bost ..... B29C 37/005 416/134 A
2014/0286782 A1* 9/2014 Mulford ..... F01D 5/32 416/220 R

* cited by examiner

*Primary Examiner* — Dwayne J White
*Assistant Examiner* — Jason Mikus

(57) ABSTRACT

An expanding lock pin for side entry turbine blades for turbines, including steam turbines compensates for worn or oversize mating pin grooves formed in rotor steeples and blade roots. The expanding pin expands circumferentially to fill the oversize mating groove. In one embodiment of the expanding lock pin a tapered plug mates with a mating tapered aperture formed in the pin. As the plug is driven into the pin its circumference increases. The expanding lock pin eliminates the need to re-machine worn or oversize pin grooves or machine new grooves.

10 Claims, 3 Drawing Sheets

EXPANDING LOCK PIN FOR TURBINE SIDE ENTRY BLADE

BACKGROUND OF THE INVENTION

1. Field of the Invention

The invention relates to lock pins for securing side entry turbine blade roots to mating steeples in the turbine rotor. More particularly the invention relates to an expanding lock pin for side entry turbine blades that compensates for oversize or worn pin grooves in the blade root, rotor steeple or both. The expanding lock pin expands circumferentially to fill any voids within the mating groove.

2. Description of the Prior Art

FIGS. 1-3 show a known turbine rotor, such as a steam turbine rotor 10 with an array of rotor steeples 12 and steeple pin retaining grooves 14. Turbine blade 20 is affixed to the rotor 10 by sliding the blade root 22 in the axial direction A to mate with a pair of flanking steeples 12. The turbine blade 20 has a blade root pin retaining groove 24 that is aligned above a corresponding steeple pin retaining groove 14, with each groove forming half of a generally cylindrical lock pin channel. Solid lock pin 30 having a fixed diameter and cylindrical circumferential surface 32 is sized to conform in a tight clearance fit with the opposed mating pin retaining grooves 14 and 24 that form the lock pin channel's generally cylindrical aperture surface. Upon pin 30 insertion the lock pin front axial face 34 abuts the inserted blade root 20 and its rear axial face 36 is flush with the same root. The lock pin 30 has a pin tongue 38 with a flat horizontal surface that abuts against and is retained by the next sequentially inserted blade root 22. The pin tongue ramped surface 39 provides an impact surface to hammer the pin 30 into the mating pin retaining grooves 14 and 24 to establish the tight clearance fit.

After a turbine, such as a steam turbine is in operational service it is periodically overhauled for maintenance. The old turbine blades are removed from the rotor, inspected and subsequently repaired or replaced by removing the existing lock pins. Due to turbine age wear and/or damage caused during existing lock pin removal the mating pin grooves 14 or 24 may become oversized and no longer provide a tight circumferential fit for a new known, solid lock pin 30. When the pin 30 diameter and grooves 14, 24 diameters no longer meet circumferential fit specification the pin/groove interface requires remedial repair. Known pin 30/groove 14,24 interface remediation methods include machining a new pair of grooves at a different axial location along the blade root 22 and steeple 12 interface or machining the existing grooves to a larger diameter and substituting a larger diameter oversize solid lock pin 30. The additional machining steps require additional time, expense and effort to complete the turbine rotor repair service.

Thus, a need exists in the art for a turbine lock pin that is capable of mating with corresponding blade root and rotor steeple grooves, whether or not the grooves are within dimensional specification or oversize beyond specification.

Another need exists in the art for a turbine lock pin that is capable of mating with oversized blade root and rotor steeple grooves without re-machining the existing grooves or machining new grooves.

An additional need also exists in the art for a turbine lock pin that is capable of mating with corresponding blade root and rotor steeple grooves, whether or not the grooves are within dimensional specification or oversize beyond specification, that is installed with existing familiar manufacture and repair service methods.

SUMMARY OF THE INVENTION

Accordingly, an object of the invention is to create a turbine lock pin that is capable of mating with corresponding blade root and rotor steeple grooves, whether or not the grooves are within dimensional specification or oversize beyond specification.

Another object of the invention is to create a turbine lock pin that is capable of mating with oversized blade root and rotor steeple grooves without re-machining the existing grooves or machining new grooves.

An additional object of the invention is to create a turbine lock pin that is capable of mating with corresponding blade root and rotor steeple grooves, whether or not the grooves are within dimensional specification or oversize beyond specification, that is installed with existing familiar manufacture and repair service methods.

These and other objects are achieved in accordance with the present invention by a turbine blade root and steeple lock pin for side entry steam and other type turbine blades, that expands circumferentially to conform with different diameter or varying diameter blade root and rotor steeple grooves. The expanding lock pin of the present invention eliminates the need to re-machine existing pin grooves or machine new ones, saving time, expense and effort during turbine service.

An embodiment of the invention features a method for locking a side entry turbine blade to a turbine rotor of a turbine, by inserting a turbine blade root between a pair of opposed rotor steeples. During insertion a blade root pin groove formed in the blade root is aligned with a corresponding steeple pin groove formed in one of the steeples. The now aligned grooves form a lock pin channel A distal end of a circumferentially expandable lock pin is inserted into the lock pin channel. The lock pin circumference is expanded into abutting contact relationship with the respective rotor steeple and blade root grooves forming the lock pin channel.

Another embodiment of the invention features a locking interface apparatus for a turbine having side entry turbine blades, including a turbine rotor having a plurality of radially outwardly projecting steeples having an axial width aligned with the rotor axis and a steeple pin groove formed in at least one of the steeples. A turbine blade having a root is slidably inserted and radially captured between a pair of opposed steeples. The blade root has a blade root pin groove that is aligned with the steeple pin groove. The pair of respective aligned grooves forms a lock pin channel having a lock pin channel inner circumference. The interface apparatus also has an expandable lock pin having a distal end that is inserted in the lock pin channel, and having a lock pin circumference that expands to contact the lock pin channel inner circumference.

An additional embodiment of the invention features an expanding lock pin apparatus for a locking interface apparatus for a turbine having side entry turbine blades of the type including a turbine rotor having a plurality of radially outwardly projecting steeples having an axial width aligned with the rotor axis, a steeple pin groove formed in at least one of the steeples; a turbine blade having a root slidably inserted and radially captured between a pair of opposed steeples and a blade root pin groove that is aligned with the steeple pin groove, the pair of respective aligned grooves forming a lock pin channel having a lock pin channel inner circumference. In this embodiment the expanding lock pin comprises a circumferentially expandable pin body having a distal end that is adapted for insertion into the mating lock pin channel The pin body has a lock pin circumference that expands to contact the mating lock pin channel inner circumference during pin insertion. In other embodiments the pin body defines a pin body aperture on an inserted distal axial end of the pin and a pin plug that is slidably inserted in the pin body distal end aperture. The pin plug has a rear axial face that contacts a distal end wall of the blade root groove. When the pin plug is driven into the pin body aperture it circumferentially expands the pin body.

The objects and features of the present invention may be applied jointly or severally in any combination or sub-combination by those skilled in the art.

BRIEF DESCRIPTION OF THE DRAWINGS

The teachings of the invention can be readily understood by considering the following detailed description in conjunction with the accompanying drawings, in which.

To facilitate understanding, identical reference numerals have been used, where possible, to designate identical elements that are common to the figures.

DETAILED DESCRIPTION

After considering the following description, those skilled in the art will clearly realize that the teachings of the present invention can be readily utilized in lock pins for gas turbine rotor blades. In an embodiment of the invention an expanding lock pin for side entry turbine blades for turbines, including steam turbines, compensates for worn or oversize mating pin grooves formed in rotor steeples and blade roots. The expanding pin expands circumferentially by deflection and/or deformation to fill the oversize mating grooves. In one embodiment of the expanding lock pin a tapered plug mates with a mating tapered aperture formed in the pin body. The pin body circumference increases as the plug is driven into the pin body aperture. The expanding lock pin eliminates the need to re-machine worn or oversize pin grooves or machine new grooves.

Figure 1:
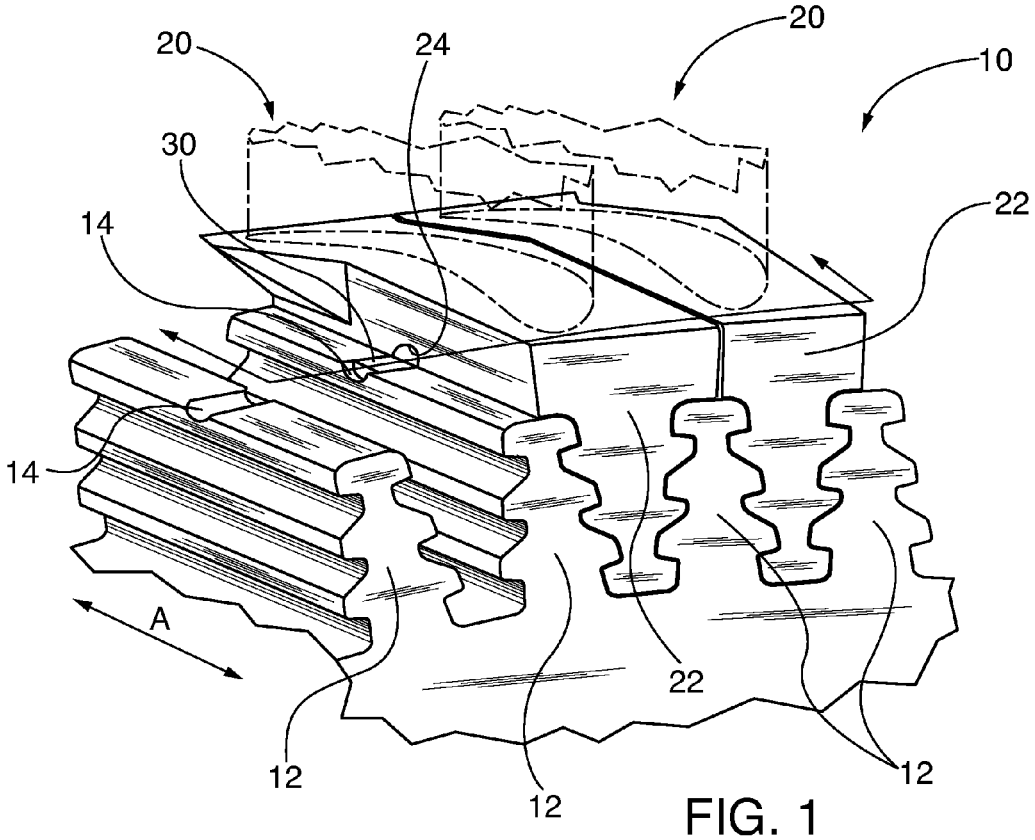
FIG. 1 PRIOR ART
FIG. 1 is a perspective view of a known rotor steeple array and mating blade roots, with a known lock pin.
Figure 2:
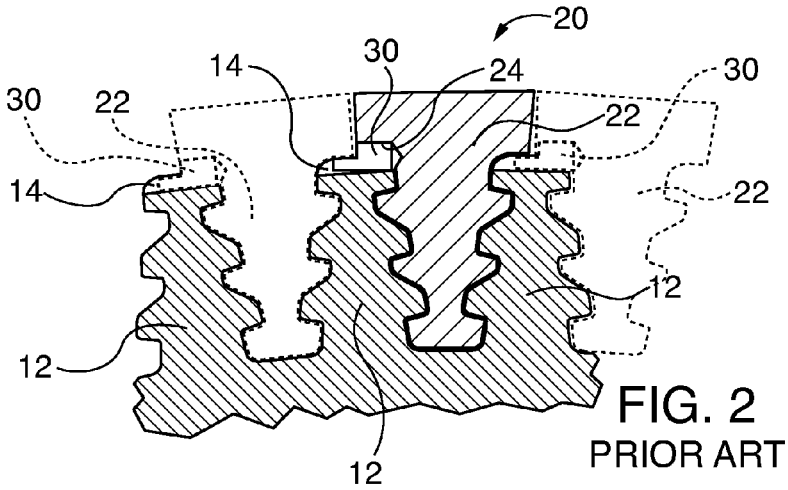
FIG. 2 PRIOR ART
FIG. 2 is a cross section of FIG. 1 taken along 2-2, showing the known rotor steeple, blade root and lock pin interface.
Figure 3:
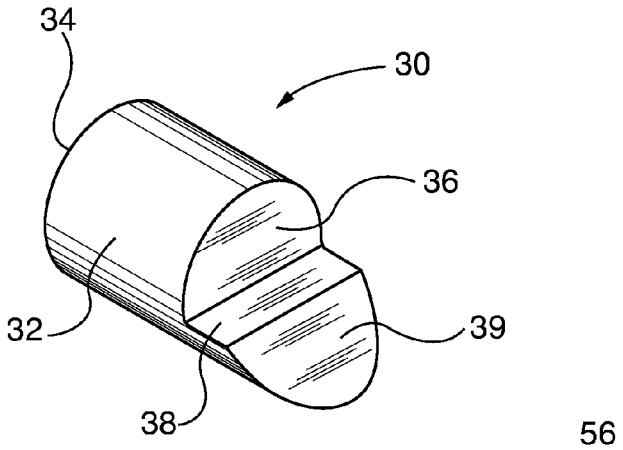
FIG. 3 PRIOR ART
FIG. 3 is a detailed perspective view of a known lock pin.
Figure 4:
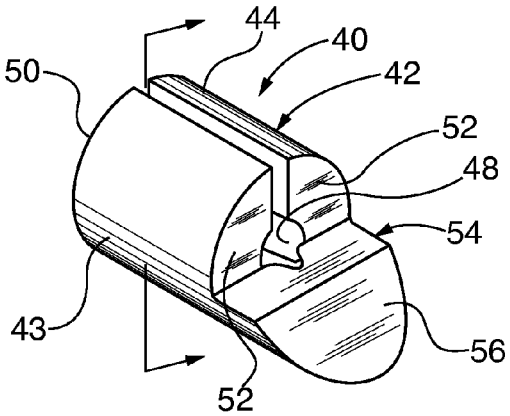
FIG. 4 is a rear perspective view of an embodiment of an expanding lock pin of the invention.
Figure 5:
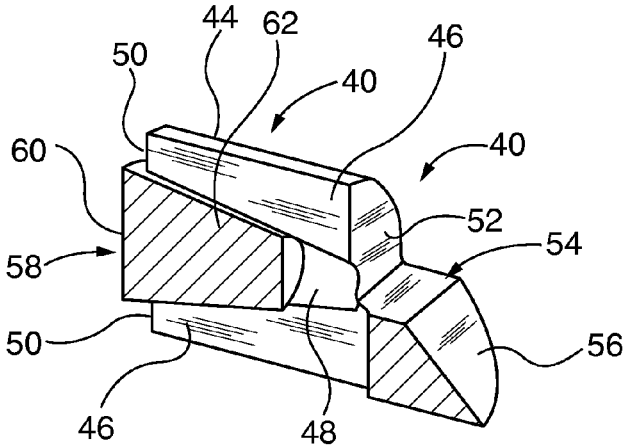
FIG. 5 is an axial cross section of the expanding lock pin of FIG. 5.
Figure 6:
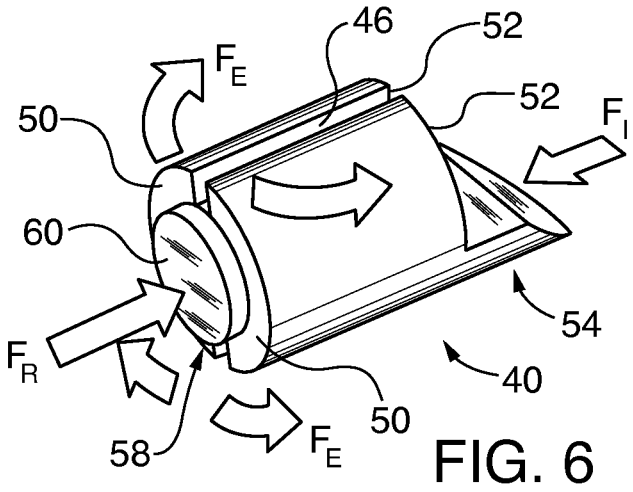
FIG. 6 is a front perspective view of the expanding lock pin of FIG. 5.
Figure 7:
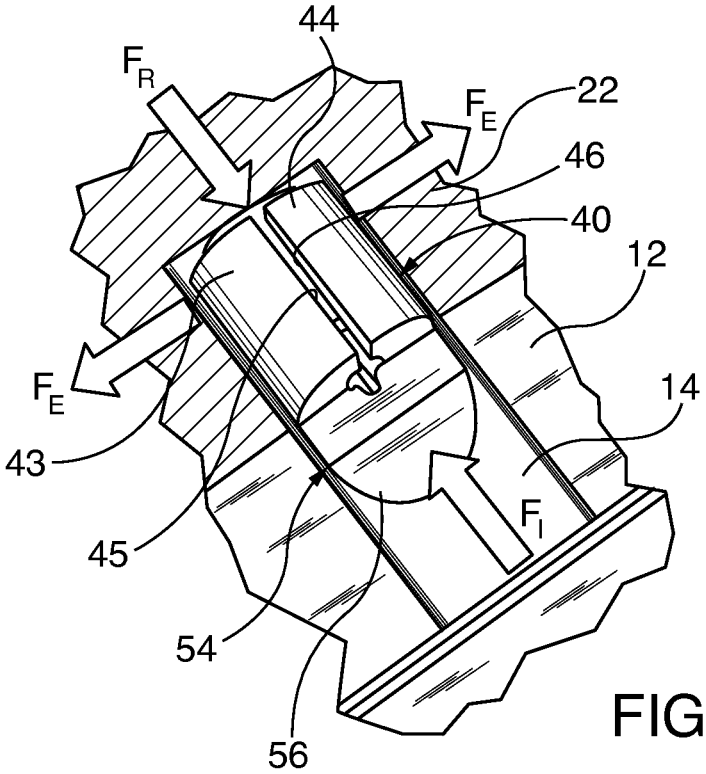
FIG. 7 is a top perspective, partially cut-away view of the expanding lock pin of FIG. 5 inserted in mating lock pin grooves of a steeple and inserted blade root.

FIGS. 4-7 show an embodiment of the expanding lock pin 40 of the invention. The expanding locking pin 40 has a split pin body 42 with a full diameter split formed by left collar 43 notch face 45 and the right collar 44 notch face 46 and a tapered central aperture 48 centrally located within the full diameter split. The outer profile of an unexpanded expanding locking pin 40 matches the profile of the known solid locking pin 30, so that it can be substituted for the known pin. Specifically the expanding locking pin 40 has a front axial face 50, a rear axial face 52 and a pin tongue 54 with ramped surface 56. The expanding locking pin 40 receives a mating pin plug 58 within the split pin body 42 tapered central aperture 48. As shown in FIG. 7, the pin plug front face 60 abuts against the mating surface of the blade root pin groove 22 and the pin plug tapered outer circumference 62 rides against the split pin body 42 tapered central aperture 48. When the split pin body 42 is driven into the mating grooves 14 and 24 that form the lock pin channel with insertion force $F_I$ the equal and opposite force $F_R$ drives the tapered pin plug 58 into the pin body and exerts circumferentially directed expanding force $F_E$ to expand the pin body outer circumference. The expanded pin body 42 outer circumference conforms to the mating grooves 14 and 24 inner diameters (i.e., the circumferential surface that forms the lock pin channel) by deflection and/or deformation, assuring a tight pin 40 fit into the rotor steeple 12 and blade root 22 interface. Another turbine blade root is slidably inserted between the next adjacent pair of opposed rotor steeples, thereby capturing the pin 40 in its inserted position within the lock pin channel formed by the mating grooves 14 and 24. Once the pin 40 is captured by the next inserted turbine blade root 20 it cannot back out of its mating lock pin channel.

The installed expanding lock pin 40 fits tightly within its lock pin channel, whether that channel is dimensioned within design specifications, oversized during machining or re-machining, or irregularly worn through service and subsequent repair. No remedial re-machining of the existing lock pin channel grooves or machining of new grooves is necessary, as the expandable lock pin 40 is selectively expanded to fill any voids between the pin outer circumference and the lock pin channel grooves 14, 24 inner circumferential surfaces.

Although various embodiments that incorporate the teachings of the invention have been shown and described in detail herein, those skilled in the art can readily devise many other varied embodiments that still incorporate these teachings. The invention is not limited in its application to the exemplary embodiment details of construction and the arrangement of components set forth in the description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass direct and indirect mountings, connections, supports, and couplings. Further, "connected" and "coupled" are not restricted to physical or mechanical connections or couplings.

What is claimed is:

1. A method for locking a metallic, side entry turbine blade to a metallic turbine rotor of a turbine, by inserting a metallic lock pin within a blind, oversized lock pin channel that exceeds circumferential dimension specifications, comprising:

inserting a metallic turbine blade root between a pair of opposed metallic rotor steeples;

aligning a blade root pin groove formed in the blade root with a corresponding steeple pin groove formed in one of the steeples and forming a blind, oversized lock pin channel with the respective grooves, for blind receipt of a lock pin, at least a portion of the oversized lock pin channel exceeding lock pin channel circumferential dimension specifications;

providing a circumferentially expandable, metallic lock pin, having:

a pin body;

an outwardly projecting pin tongue on a proximal end of the pin body, the pin tongue having a stepped profile, for recessed orientation within a steeple pin groove in which said expanding lock pin is inserted, and for abutting capture by a subsequently inserted turbine blade root;

a tapered aperture on a distal axial end of the pin body;

a mating tapered pin plug slidably inserted into the tapered aperture of the pin body, the pin plug having a front face projecting outwardly from the distal axial end of the pin body, for contact with a distal end wall of the blade root groove that terminates a distal end of the blind, oversized lock pin channel;

inserting the distal end of the pin body, including the front face of its inserted, tapered pin plug, of the circumferentially expandable lock pin into the oversized lock pin channel; and expanding the lock pin circumference into abutting contact relationship with the respective rotor steeple and blade root grooves forming the blind, oversized lock pin channel, by impact-driving the lock pin tongue into the lock pin channel, so that the inserted front face of the tapered pin plug contacts a distal end wall of the blade root groove and circumferentially expands the lock pin by driving the pin plug deeper into the mating tapered aperture of the pin body distal end.

2. The method of claim 1, further comprising inserting sequentially another turbine blade root between a next sequential pair of opposed rotor steeples and capturing the expandable lock pin tongue within the lock pin channel.

3. The method of claim 1, the turbine comprising a steam turbine.

4. The method of claim 1, the provided pin body comprising a split pin body having left and right collars defining the pin body tapered aperture, said collars deflecting or deforming upon driven insertion of the pin body tongue into the lock pin channel.

5. A locking interface apparatus for a turbine having metallic, side entry turbine blades that are retained by insertion of a metallic lock pin within a blind, oversized lock pin channel that exceeds circumferential dimension specifications, comprising:

a turbine rotor having a plurality of radially outwardly projecting, metallic steeples having an axial width aligned with the rotor axis, and a steeple pin groove formed in at least one of the steeples;

a turbine blade having a metallic root slidably inserted and radially captured between a pair of opposed steeples and a blade root pin groove that is aligned with the steeple pin groove, the pair of respective aligned grooves forming a blind, oversized lock pin channel having a lock pin channel inner circumference that exceeds lock pin channel circumferential dimension specifications; and a circumferentially expanded, metallic lock pin inserted and inpact-driven into the blind, oversized lock pin channel, in abutting contact relationship with the lock pin channel inner circumference, said lock pin, having:

a pin body;

an outwardly projecting pin tongue on a proximal end of the pin body, the pin tongue having a stepped profile, in recessed orientation within the steeple pin groove, and for abutting capture by a subsequently inserted turbine blade root;

a tapered aperture on a distal axial end of the pin body;

a mating tapered pin plug slidably inserted into the tapered aperture of the pin body, the pin plug having a front face projecting outwardly from the distal axial end of the pin body;

the pin plug front face in contact with a distal end wall of the blade root groove that terminates a distal end of the blind, oversized lock pin channel, the tapered pin plug insertion position within the mating tapered aperture of the pin body distal end expanding the lock pin by impact-driving the pin tongue deeper into the lock pin channel.

6. The apparatus of claim 5, further comprising a second turbine blade having a blade root inserted sequentially between a next sequential pair of opposed rotor steeples that captures the expandable lock pin within the lock pin channel.

7. The apparatus of claim 6, the turbine comprising a steam turbine.

8. An expanding, metallic lock pin apparatus for a locking interface apparatus for a turbine having side entry, metallic turbine blades that are retained by insertion of a metallic lock pin within a blind, oversized lock pin channel that exceeds circumferential dimension specifications, the turbine of the type including a turbine rotor having a plurality of radially outwardly projecting, metallic steeples having an axial width aligned with the rotor axis, a steeple pin groove formed in at least one of the steeples; a turbine blade having a metallic root slidably inserted and radially captured between a pair of opposed steeples and a blade root pin groove that is aligned with the steeple pin groove, the pair of respective aligned grooves forming a blind, oversized lock pin channel having a lock pin channel inner circumference that exceeds circumferential dimension specifications, the expanding lock pin comprising:

a circumferentially expandable metallic pin body, for insertion into a blind, oversized pin channel, having:

an outwardly projecting pin tongue on a proximal end of the pin body, the pin tongue having a stepped profile, for recessed orientation within the steeple pin groove, and for abutting capture by a subsequently inserted turbine blade root;

a tapered aperture on a distal axial end of the pin body;

a mating tapered, metallic pin plug slidably inserted into the tapered aperture of the pin body, the pin plug having a front face projecting outwardly from the distal axial end of the pin body;

the pin plug front face for contact with a distal end wall of the blade root groove that terminates a distal end of the blind, oversized lock pin channel, the tapered pin plug insertion position within the mating tapered aperture of the pin body distal end expanding the lock pin when impact-driving the pin tongue deeper into the lock pin channel.

9. The apparatus of claim 8, the pin body comprising a split pin body having left and right collars defining the tapered pin body aperture.

10. The apparatus of claim 9, the left and right pin collars deflecting or deforming upon driven insertion of the pin body tongue into the blind, oversized lock pin channel.

* * * * *